United States Patent [19]

Dickey et al.

[11] 3,980,383

[45] Sept. 14, 1976

[54] MULTIPLANE TERMINAL BLOCK

[75] Inventors: Larry Wayne Dickey, Hackettstown; Edward Lewis Ramsey, Jr., Martinsville, both of N.J.

[73] Assignee: Bell Telephone Laboratories, Incorporated, Murray Hill, N.J.

[22] Filed: Apr. 18, 1975

[21] Appl. No.: 569,584

[52] U.S. Cl. ..... 339/198 R

[51] Int. Cl.[2] ..... H01R 9/16

[58] Field of Search ..... 339/198 R, 214 R, 217 R, 339/218 R

[56] References Cited

UNITED STATES PATENTS

| | | | |
|---|---|---|---|
| 1,141,598 | 6/1915 | Ziegler | 339/214 R |
| 3,323,021 | 5/1967 | Sever | 339/218 R |

FOREIGN PATENTS OR APPLICATIONS

| | | | |
|---|---|---|---|
| 1,128,501 | 4/1962 | Germany | 339/198 S |

*Primary Examiner*—Joseph H. McGlynn
*Assistant Examiner*—Craig R. Feinberg
*Attorney, Agent, or Firm*—J. S. Cubert

[57] ABSTRACT

A multiplane terminal block adapted to provide rearrangeable electrical connections includes a plurality of spaced insulating terminal posts extending outwardly on one side of a rectangular block of insulating material. A conductive element fixedly inserted into each post protrudes through the block and provides a rearrangeable clamp connection to an electrical conductor at the top of the post and a fixed connection to an electrical conductor on the other side of the block. Each terminal post is of a different length than the immediately adjacent terminal posts whereby a relatively long path between conductive elements with close spacing between adjacent posts is provided.

6 Claims, 4 Drawing Figures

MULTIPLANE TERMINAL BLOCK

BACKGROUND OF THE INVENTION

Our invention relates to electrical connection arrangements and more particularly to terminal blocks for use in interconnecting electrical conductors.

In electronic and communication equipment, it is often necessary to provide interconnections for large numbers of conductors in diverse environments. Where large numbers of wires interconnected in centrally located enclosures are subject to rearrangement, an array of terminal blocks having mechanical connection points is generally utilized. Each terminal block must be of compact construction adapted to make the required connections in a convenient layout in the smallest possible space and designed to prevent high voltage breakdown and electrical leakage.

In telephone and other communication systems, interconnection enclosures are often placed at outside locations where the terminal blocks in the enclosures are subject to high humidity, salt air, and other contaminants. The adverse environmental conditions and the contaminants may cause lower electrical resistance between the terminals so that arcing and detrimental electrical leakage can occur. Barriers may be placed between the spaced metal terminal inserts in a terminal block to prevent arcing. These barriers, however, are relatively ineffective to prevent electrical leakage due to condensation of salt-bearing moisture or other contaminants and tend to act as a bridge for condensed moisture. Such barriers also increase the spacing between terminals. To maintain a high electrical resistance between terminals in such an adverse environment, the spacing between terminals of the block has generally been increased to an extent where the number of connections on each terminal block is limited.

It is an object of the invention to provide an economical terminal block arrangement having an orderly sequence of terminals with minimal spacing between terminals and a high degree of immunity from arcing and electrical leakage.

SUMMARY OF THE INVENTION

According to the invention a multiplane terminal block adapted to provide rearrangeable electrical connections includes a plurality of spaced insulating terminal posts extending outwardly from one surface of a block of insulating material. A conductive element is fixedly inserted into each terminal post. Each terminal post is of a different length than the immediately adjacent terminal posts whereby a high resistance path is maintained between the post mounted conductive elements.

According to one aspect of the invention, the insulating block is generally rectangular and each conductive element comprises an upper portion extending from its terminal post on the block and adapted to clamp one or more electrical conductors. The lower portion of each conducting element extends through the insulating block and is adapted to provide an electrical connection point for other electrical conductors.

According to another aspect of this invention, the plurality of insulating posts comprises a group of first length posts and a group of second length posts interleaved in an alternating sequence. Each first length post is immediately adjacent to only second length posts and each second length post is immediately adjacent to only first length posts. The alternating sequence of first and second length posts provides an extended electrical path between adjacent conductive elements with minimal spacing between adjacent posts.

According to yet another aspect of the invention, the insulating block includes an extension portion around the edges thereof adapted to form a cavity surrounding the lower portions of the conducting elements protruding through the block. A suitable insulating compound fills the block cavity to provide a contaminant-free environment for the electrical connections to the lower conductive element portions.

DETAILED DESCRIPTION

Figure 1:
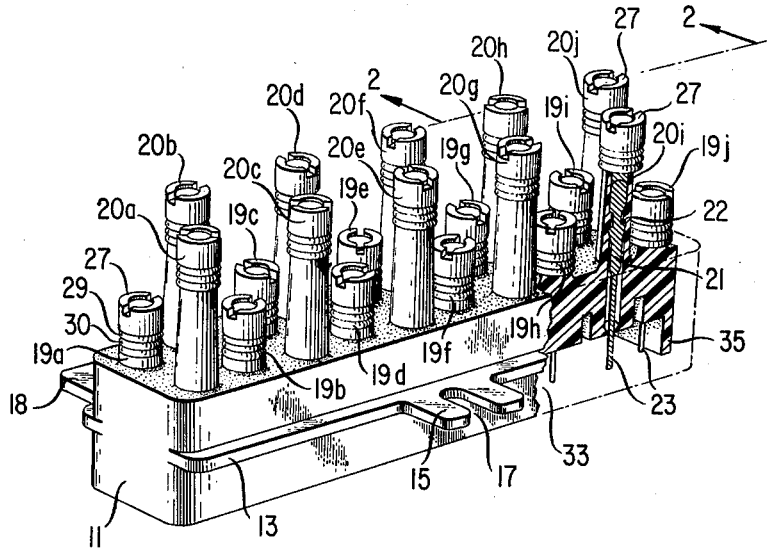
FIG. 1 is a perspective view of a terminal block embodying the principles of the invention.

FIG. 1 shows a terminal block illustrative of the invention in which a plurality of insulating posts, 19*a* through 19*j* and 20*a* through 20*j*, extend outwardly from the upper surface of rectangular block 11. Block 11 is made of an insulating material, and preferably the posts and the block are of unitary construction. The posts may, for example, be integrally molded with block 11 out of an insulating material which may, for example, be any suitable plastic composition. The outer edges of the block lower surface project downwardly to form cavity 33 below said lower surface. Extensions 13 on the edges of block 11 determine the height of the block above a base plate (not shown) in which the block may be mounted in an arrangement with similar terminal blocks. Tabs extending from the block, such as tab 15, include hollow section 17 to permit fastening of the block to the base plate by means of bolts or other devices.

The exterior of each post in FIG. 1 is generally cylindrical in shape and may be tapered inwardly from block 11. The vertical hole in each post centered along the longitudinal axis of the post provides a passageway for a conductive element. Posts 19*a* through 19*j* are of one uniform length and posts 20*a* through 20*j* are of a different uniform length. Each row includes an alternating sequence of short posts 19 and long posts 20. The rows are aligned so that the short posts 19 of the rows are arranged in echelon. The long posts 20 of the rows are similarly arranged in echelon.

Figure 3:
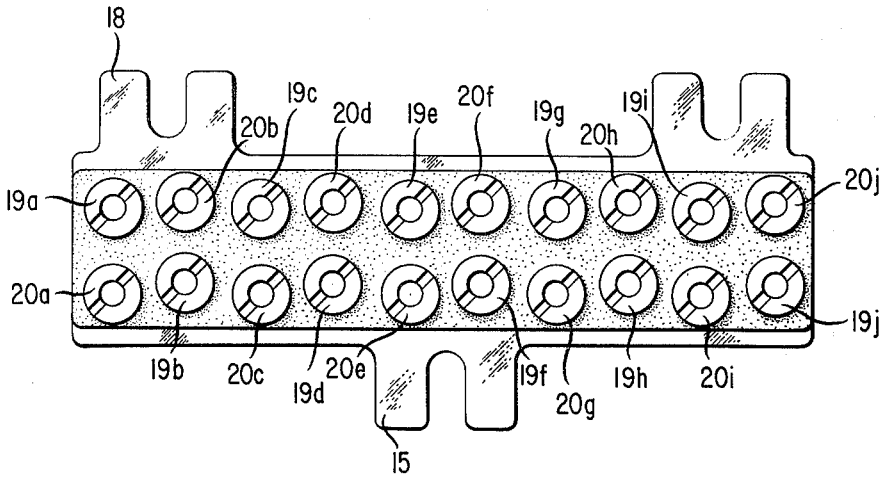
FIG. 3 shows the top view of the terminal block of FIG. 1.

In accordance with the invention, each long post 20 is immediately adjacent to only short posts 19 and each short post 19 is immediately adjacent to only long posts 20. For example, long post 20*c* is immediately adjacent to short posts 19*b*, 19*c*, and 19*d* and is a greater distance from all other long posts, such as posts 20*b* and 20*d*. Similarly, short post 19*c* is immediately adjacent to long posts 20*b*, 20*c*, and 20*d* but is removed from the nearest short posts 19*b* and 19*d*. The spacing between short and long posts is readily apparent in FIG. 3 which shows a top view of the terminal block. In FIG. 3, the distance between similar length posts is much greater than the distance between different length posts.

The right end portion of the terminal block of FIG. 1 is shown in cutaway view to exhibit the construction of the block and posts in greater detail. A conductive element operative as a terminal connection is placed through the vertical hole of each post. Metallic terminal 21 is inserted in post 20*i* so that the lower stud portion 23 extends downwardly through block 11 into cavity 33. Every other post in FIG. 1 similarly has a metallic insert therethrough. The upper portion of terminal 21 includes binding post 27 adapted to receive and hold one or more conductors. The intermediate portion of terminal 21 has a generally rectangular cross section and comprises angular protrusions 22 which fixedly attach terminal 21 in post 20*i* and aid in orienting terminal 21 in post 20*i*. The other metallic terminals of the terminal block are similarly constructed.

Figure 2:
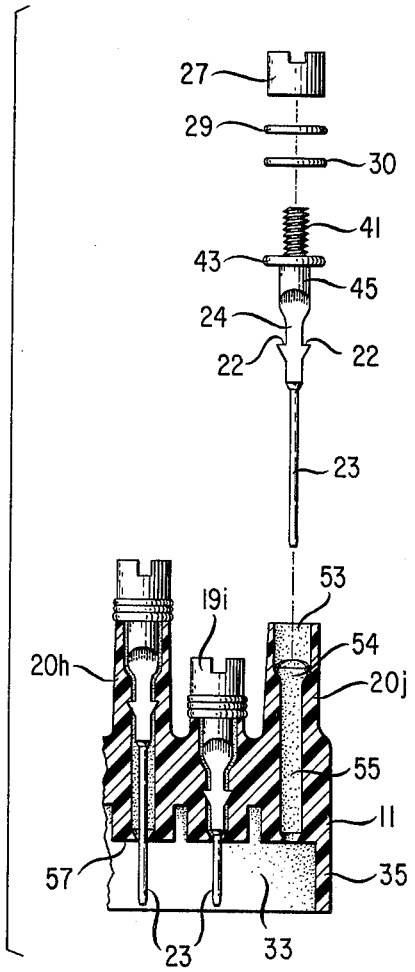
FIG. 2 shows a front view of a portion of the terminal block of FIG. 1 taken along lines 2—2 and an exploded view of a conductive element useful therein.

FIG. 2 shows a section of the terminal block taken along lines 2—2, and an exploded view of the metallic terminal to be inserted into post 20*j*. The terminals associated with posts 20*h* and 19*i* are shown affixed therein. Referring to the metallic terminal associated with post 20*j*, the terminal comprises a threaded upper portion 41 connected to a generally cylindrical section 45 by flat cylindrical plate 43. Plate 43 rests on the top of cylindrical post 20*j* above cavity 53. Washer 30 is placed on plate 43 and a conductor termination member is placed between washers 30 and 29. Slotted binding nut 27 includes an internal thread. Nut 37 is threadedly forced against washer 29 to rigidly but removably affix the conductor termination to the upper portion of the metallic terminal.

Lower portion 23 of the metallic terminal comprises a relatively narrow cross-section rod which protrudes through the lower surface of block 11 into cavity 33. An electrical conductor is affixed to lower portion 23 in cavity 33. The rod may be of rectangular cross section adapted to receive the electrical conductor by means of a wire wrap connection well known in the art. It is to be understood that other connection means known in the art may also be used.

The intermediate portion of the metallic terminal between plate 43 and lower portion 23 is forced into cavities 54 and 55 of post 20*j*. A cylindrical section 45 of the intermediate portion fits into cylindrical cavity 53, while rectangular section 24 of the intermediate portion fits into cavity 55. Cavities 54 and 55 have rectangular-shaped walls adapted to receive terminal sections 24 and 23, respectively. Angular protrusions 22 on two opposite sides of rectangular section 24 are adapted to permanently affix the metallic terminal into position in post 20*j*, said position being determined by plate 43 bearing against the top of post 20*j*. Rectangular section 24 prevents rotational movement of the metallic terminal in post 20*j*, and angular protrusions 22 prevent both rotational and vertical movement of the metallic terminal in post 20*j*. The metallic terminal on post 20*h* is identical to the terminal to be inserted into post 20*j*. The metallic terminal in short post 19*i* of FIG. 2 is of the same construction as the terminals for posts 20*h* and 20*j*, but lower portion 23 thereof is shorter so that it fits within cavity 33.

As shown in FIG. 3, posts 19 of each row are slightly offset inwardly from posts 20 of the same row. The offset arrangement facilitates identification of the lower portion rods protruding through the lower surface of block 11. Each post 20 is tangent to an edge of block 11, and posts 19 are spaced away from the edge whereby wires parallel to the length of the block bear against the insulated portions of posts 20 and are directed away from the metallic terminals of posts 19.

An assembly of terminal blocks of FIG. 1 is used to selectively interconnect a first group of conductors that may, for example, form part of a cable from a communication switching center, such as a telephone central office, to a third group of conductors connected to various stations associated with the communication system. A second group of conductors interconnects the lower portions of the terminals of the terminal block assembly. The conductors of each group are arranged in pairs and each pair is connected to an assigned terminal pair consisting of one long terminal and an adjacent short terminal in the same row. The use of long and short terminals advantageously identifies the conductor connections to the terminal pair.

Figure 4:
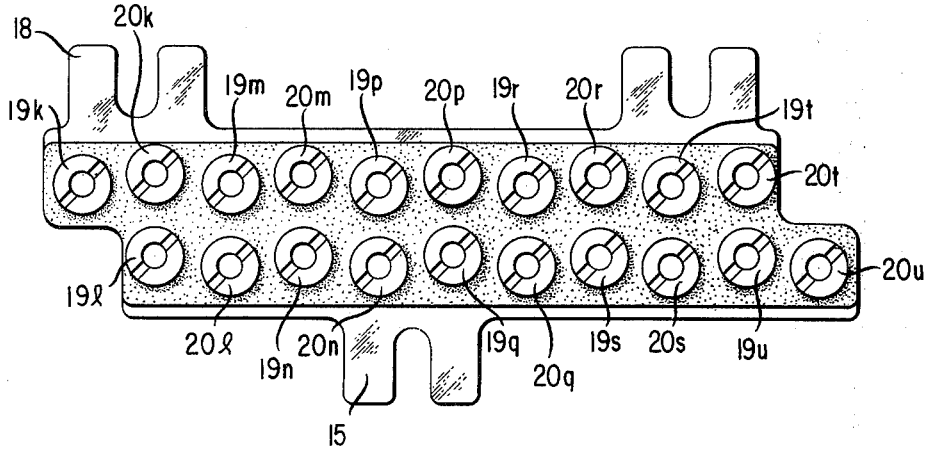
FIG. 4 depicts a top view of another terminal block embodying the principles of the invention.

The terminal arrangement of FIG. 3 provides a rearrangeable conductor pair connection. The first conductor of one pair may be connected to short post 19*a* and the second conductor of the pair may be connected to the adjacent long post terminal 20*b* in the same row. The first conductor of another pair can then be connected to the long post terminal 20*a* in the next row, and the second conductor of this pair may be connected to short post terminal 19*b*. Thus, similar conductors of each pair are connected to different length posts. In the arrangement of FIG. 4, the rows of terminal posts are offset by one post so that the first conductor of each pair is always connected to a short post, and the second conductor of each pair is always connected to a long post. The arrangement of FIG. 4 provides an identification scheme which simplifies installation, testing, and servicing of the communication equipment. The arrangement of FIG. 4 may advantageously by used to identify the voltage polarity in each pair.

Permanent connections between the lower portion rods of selected terminal blocks arranged in an assembly are made through the second group of conductors which are selectively connected to the rods protruding through the lower surfaces of the terminal blocks. In this manner, the first and third group conductors are selectively interconnected through the terminal block assembly via the second group conductors and the first and third group conductor interconnections are rearrangeable in accordance with system requirements. The second group conductors are permanently connected to the terminal blocks.

In high humidity environments, water droplets with or without dissolved contaminants tend to accumulate between terminal posts due to condensation of moisture on the metallic terminals. In terminal block arrangements with closely spaced terminal posts of uniform length, such droplets can readily bridge between adjacent metallic terminals, causing electrical leakage therebetween. The bridging is enhanced if conductors are placed in the space between adjacent terminals. The lower electrical resistance between the bridged terminals adversely affects electrical transmission, and electrical noise and increased cross-talk result. If only long terminal posts are used, capillary action could result in bridging. In accordance with the invention, the use of adjacent short and long terminal posts prevents bridging between the adjacent posts.

The construction shown in FIG. 2, for example, allows water droplets to accumulate around post 19*i* and the metallic terminal insert therein, but the substantially greater length of adjacent posts 20*h* and 20*j* prevents bridging between the metallic terminals of posts 20*h* and 20*j* and the metallic terminal of post 19*i*. Further, the use of different length adjacent terminal posts provides a relatively long bridge free path between adjacent metallic terminals with relatively close spacing between the terminals. Thus a high terminal density is achieved without adversely affecting the electrical properties of the termination arrangement. Advantageously, the long path between adjacent terminals and the difference in terminal height also protect against bridging by other contaminants, such as metallic slivers, insects, and spider webs.

The connections to the upper portions of the terminal blocks, according to the invention, are readily rearrangeable and the varying lengths of the terminal posts provide suitable protection against electrical leakage without affecting later rearrangements of the electrical conductors connected thereto. Since connections to the lower terminal portions in cavity 33 are relatively permanent, protection against moisture, contaminants and inadvertent short circuits is provided by placing a suitable insulative, moisture resistant potting compound well known in the art in cavity 33 after the connections to rods 23 of the terminal block are completed.

Although the invention has been described with reference to particular embodiments thereof, it is to be understood that modifications and changes in construction may be made by those skilled in the art without departing from the spirit and scope of the invention. For example, first, second and third length terminal posts may be suitably arranged in the block according to the invention with each length terminal post being adjacent to only other length terminal posts. Additionally, a terminal block having different height adjacent posts extending from both upper and lower surfaces of a central rectangular block may be constructed in accordance with the principles of the invention.

What is claimed is:

1. A terminal block for interconnecting electrical conductors comprising a generally rectangular block of insulating material, a plurality of insulating terminal posts extending outwardly from said block, said terminal posts being arranged in rows, each row comprising an alternating sequence of first and second length terminal posts in spaced relation, the first length posts in each row being adjacent to the second length posts of the adjacent row, and a conductive element fixedly inserted into each post comprising an upper portion for releasable connection with at least one electrical conductor, and a lower portion protruding through said block adapted to fixedly interconnect with an electrical conductor.

2. A terminal block for interconnecting electrical conductors according to claim 1 wherein each terminal post comprises a hollow, generally cylindrical post, and the lower portion of each conductive element comprises a rectangular cross-section rod adapted for wire wrap connection with an electrical conductor.

3. A terminal block for interconnecting electrical conductors according to claim 1 wherein each terminal post comprises a hollow cylinder having an interior rectangular shaped surface centered along the longitudinal axis thereof, said conductive element comprising an intermediate portion between said upper and lower portions having a generally rectangular cross-section including means for fixedly attaching said conductive element to the interior surface of said hollow cylinder.

4. A terminal block for interconnecting electrical conductors according to claim 3 wherein said hollow cylinder comprises rectangularly arranged interior walls along the longitudinal axis of said cylinder, and said fixedly attaching means comprises a pair of outwardly extending angular protrusions on opposite sides of said rectangular cross-section intermediate portion.

5. A terminal block for interconnecting electrical conductors comprising a block of insulating material, a plurality of spaced insulating terminal posts extending outwardly from a first surface of said block, and a conductive element mounted in each terminal post, said plurality of terminal posts comprising a group of first length posts and a group of second length posts, said first length posts being interleaved with said second length posts, each first length post being immediately adjacent to only second length posts, and each second length post being immediately adjacent to only first length posts.

6. A terminal block for interconnecting a first plurality of electrical conductors to a second plurality of electrical conductors comprising a molded insulating member including a generally rectangular block and a plurality of spaced terminal posts extending outwardly from a first surface of said rectangular block, and a conductive element inserted into each post comprising an upper portion for releasably clamping at least one of said first plurality of electrical conductors, a lower portion protruding through a second surface of said block for affixing at least one of said second plurality of electrical conductors, and an intermediate portion between said upper and lower portions for fixedly attaching said conductive element to said terminal post, said spaced terminal posts being arranged in rows along the length of said block, each row comprising an alternating sequence of first and second height posts, the first height posts of one row being in echelon relation with the first height posts of the adjacent row, the second height posts of said one row being in echelon relation with the second height posts of the adjacent row.

* * * * *